United States Patent [19]

Cowles

[11] Patent Number: 4,848,330

[45] Date of Patent: Jul. 18, 1989

[54] RESPIRATOR SYSTEM

[76] Inventor: Charles M. Cowles, 4405 Fishermans Ct., Olney, Md. 20832

[21] Appl. No.: 140,800

[22] Filed: Jan. 5, 1988

Related U.S. Application Data

[63] Continuation of Ser. No. 925,216, Oct. 31, 1986, abandoned.

[51] Int. Cl.[4] ..... A62B 7/12

[52] U.S. Cl. ..... 128/200.24; 128/201.23; 128/206.24

[58] Field of Search ..... 128/200.24, 201.11, 128/201.15, 201.19, 201.22, 201.23, 201.24, 201.25, 201.26, 201.27, 201.28, 201.29, 202.27, 206.15, 206.24, 206.23, 207.12, 206.28, 206.17

[56] References Cited

U.S. PATENT DOCUMENTS

| | | | |
|---|---|---|---|
| 1,007,644 | 10/1911 | Cocke | 128/207.12 |
| 1,071,223 | 8/1913 | Garrity | 128/201.23 |
| 1,096,761 | 5/1914 | Scheer | 128/206.23 |
| 3,529,594 | 9/1970 | Charnley | 128/201.23 |
| 3,955,570 | 5/1976 | Hutter | 128/201.23 |
| 4,055,173 | 10/1977 | Knab | 128/201.23 |
| 4,173,220 | 11/1979 | Ratz et al. | 128/201.19 |
| 4,440,163 | 4/1984 | Spergel | 128/206.24 |
| 4,534,344 | 8/1985 | Constance-Hughes | 128/201.23 |
| 4,651,727 | 3/1987 | Howorth | 128/201.23 |

*Primary Examiner*—Max Hindenburg
*Assistant Examiner*—John P. Lacyk
*Attorney, Agent, or Firm*—Nies, Webner, Kurz & Bergert

[57] ABSTRACT

An improved respirator system which protects the head of the operator while allowing excellent visibility and improved breathing conditions in a contaminated environment is disclosed. The system includes a hose mask with facepiece having a lens which provides improved visibility to both sides, as well as above and below the operator. The facepiece is provided with a seal around the head portion of the wearer with connection through a suitable hose ventilating system to a source of uncontaminated air at atmospheric pressure. The respirator is of the class B type, in which air is brought into the lungs from a source of uncontaminated air at ambient conditions through the bodily breathing function of the operator alone, without the use of an air compressor or a supply of compressed air.

2 Claims, 3 Drawing Sheets

RESPIRATOR SYSTEM

This is a continuation of Ser. No. 925,216, filed 10/31/86, now abandoned.

BACKGROUND AND SUMMARY OF THE INVENTION

The present invention relates to a respirator system for use in an enclosed contaminated environment. More particularly, the present invention relates to a respirator system including a face mask for use in an environment such as an automobile body shop, furniture refinishing shop or boatyard, to protect an operator or spray mechanism so as to allow normal operations in a toxic or contaminated environment.

Previous protective devices including face masks are described, for example, in the following U.S. Patents: No. 2,818,859 to Peterson; No. 2,965,902 to Louch; No. 3,323,135 to Miller; No. 3,827,433 to Shannon; No. 4,011,865 to Morishita; No. 4,136,688 to Gorman; and No. 4,440,163 to Spergel.

At the present time, auto body painters in particular are being subjected to potential health problems when operating in an environment with paint products containing isocyantes such as are found in polyurethane paint additives. The use of various types of safety equipment such as downdraft booths and air-line respirators has not prevented the occurrence of health problems such as dizziness and nausea, as well as possible long-term effects such as kidney damage and neurological disease.

By the present invention, there is provided an improved respirator system which protects the head of the operator in a contaminated environment so as to allow the operator to have improved visibility as well as to breathe freely while operating in a contaminated or toxic environment. The present respirator system includes a facepiece having a lens portion which provides improved visibility to both sides as well as above and below the operator, an improvement which is of particular advantage to an operator of painting equipment in an automobile body shop. The facepiece is provided with a seal around the head portion of the wearer with connection through a suitable hose ventilating system to a source of uncontaminated air at atmospheric pressure. The respirator is of the class B type, in which air is brought into the lungs from a source of uncontaminated air through the bodily breathing function of the operator alone, without the use of an air compressor or a supply of compressed air.

DESCRIPTION OF THE PREFERRED EMBODIMENTS

Figure 2:
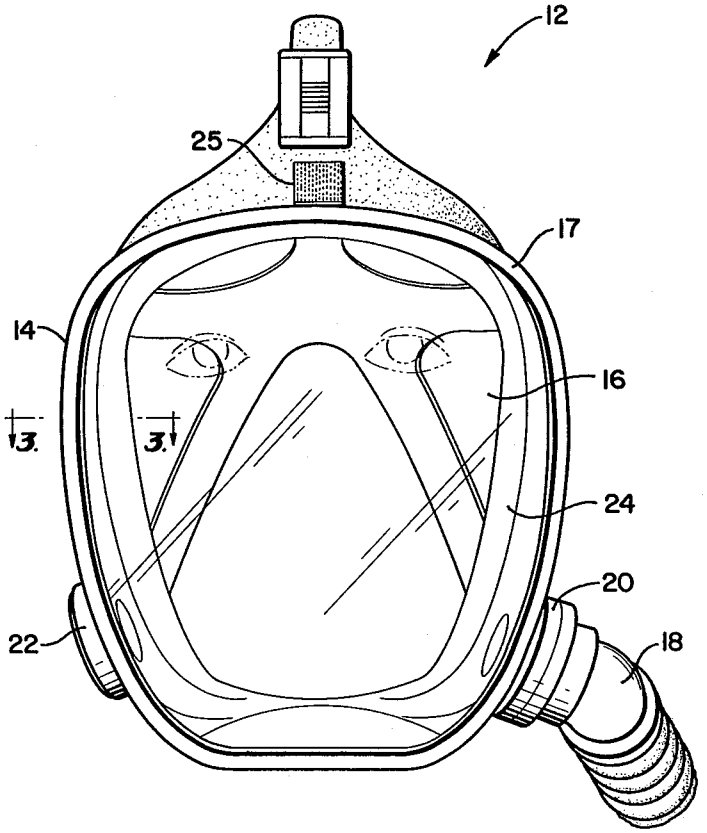
FIG. 2 is a front elevational view of the mask of FIG. 1.
Figure 1:
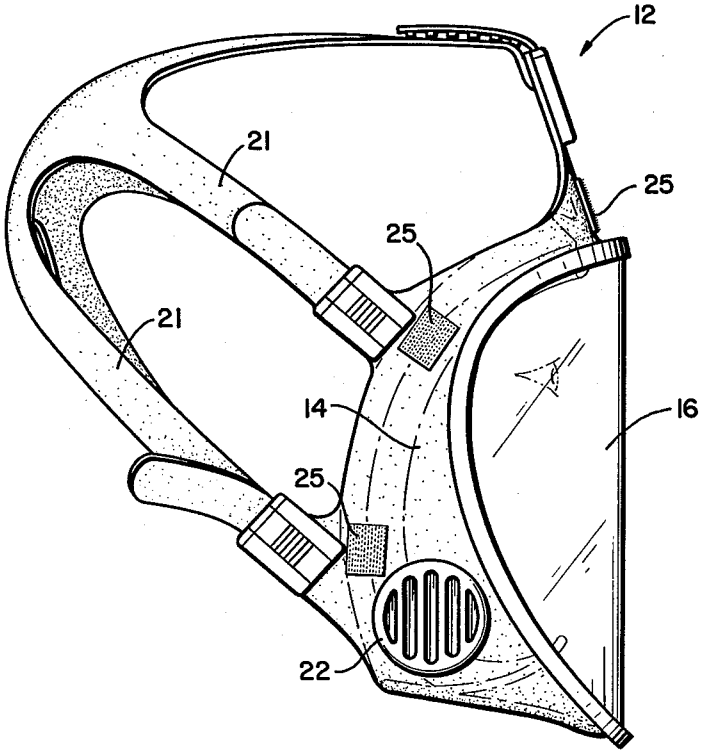
FIG. 1 is a side elevational view of the mask employed with the respirator system of the present invention.
Figure 3:
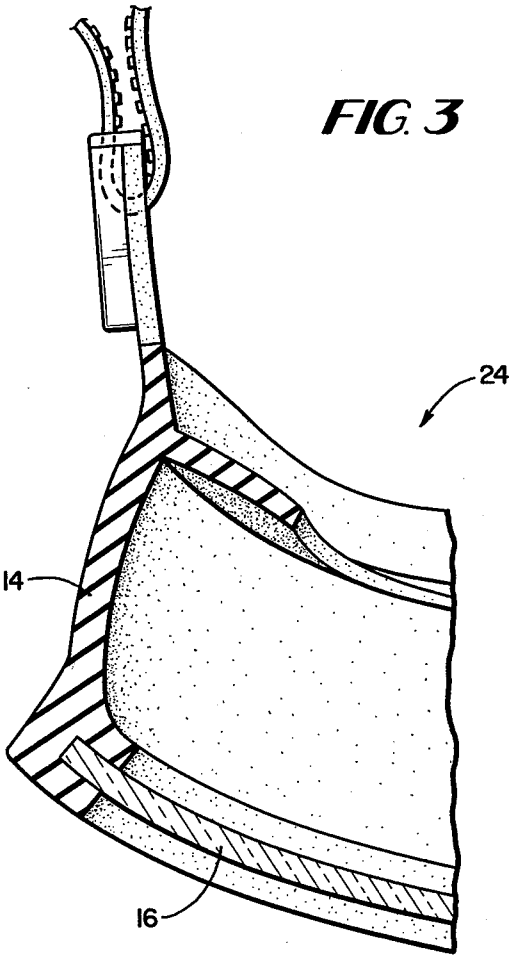
FIG. 3 is a partial sectional view taken along line 3—3 of FIG. 2.
Figure 4:
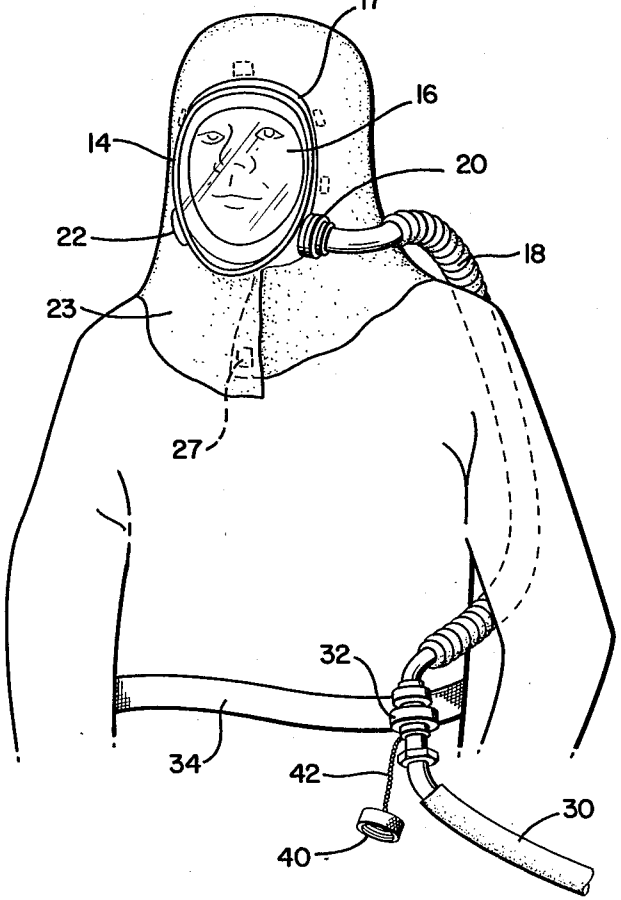
FIG. 4 is a perspective view showing the mask of FIG. 1 as installed on a user of the device.
Figure 5:
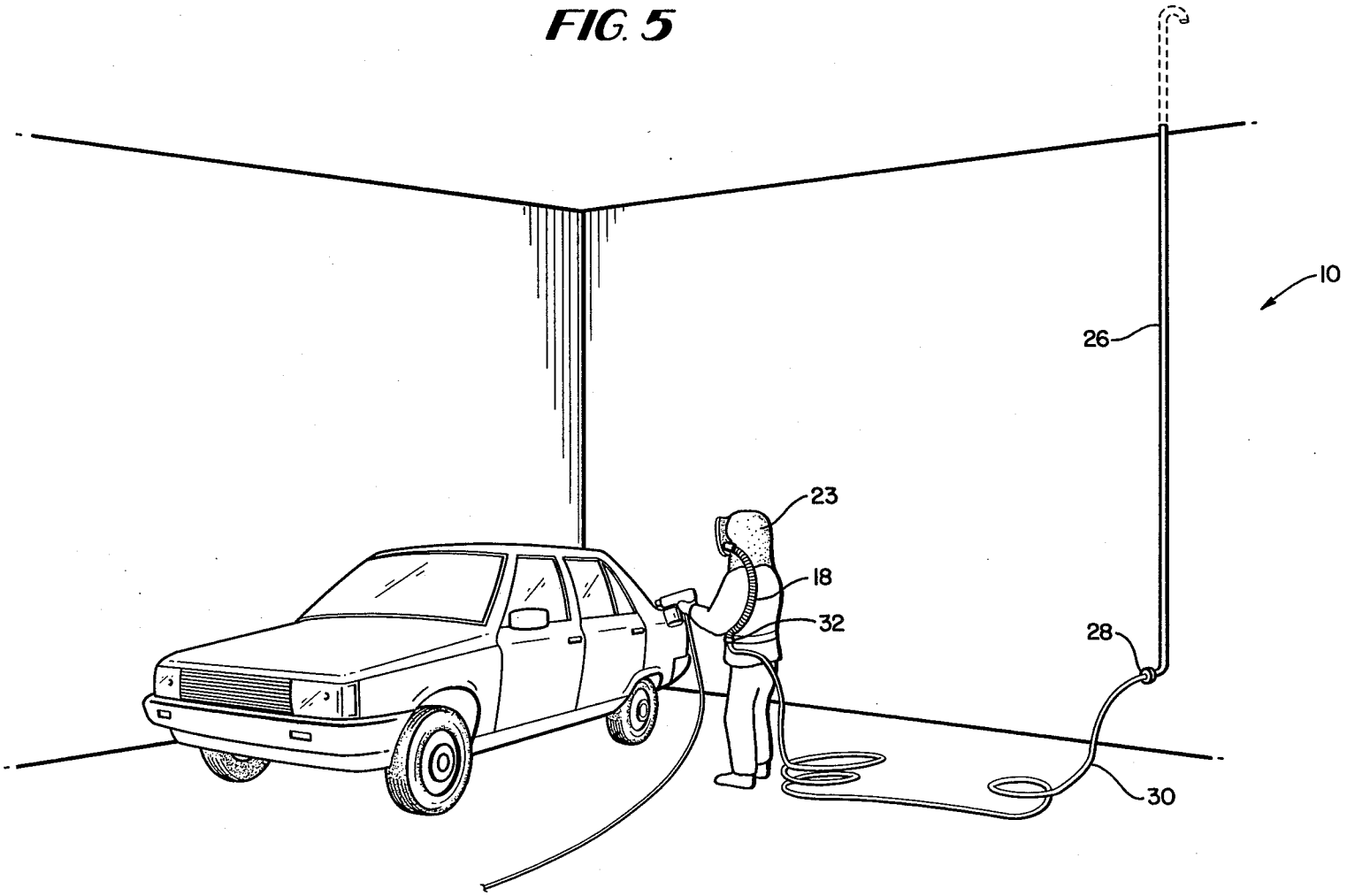
FIG. 5 is a perspective view of the respirator system of the present invention.

In the embodiment of the present invention as shown in FIGS. 1 through 5, there is provided a respirator system 10 which includes a hose mask 12 with a gas tight enclosure capable of substantially enclosing a person's face between forehead and chin and having a facepiece 14 with lens 16 mounted in lens ring 17. A hose 18 for connecting the interior of the hose mask 12 in fluid communication with the atmosphere exterior to the enclosed environment is connected by a suitable conventional coupling 20 with the hose mask 12.

The hose mask 12 is provided with straps 21 for securing the mask on the head and a protective head cover 23 formed of a sheet of non-porous plastic or rubberized fabric is connected by suitable attachments 25 such as Velcro attachments to the mask 12 and with a closure 27 at the lower front edge thereof to allow the cover 23 to fully protect the head of the user from paint or other materials.

The inlet connection 20 for providing air to the inlet of the hose mask 12 is positioned at approximately the level of the chin on one side of the chin and with an air outlet 22 positioned at approximately the level of the chin on the opposite side of the hose mask 12 from the inlet connection. In this manner, maximum visibility is provided in every direction, including a downward direction. In addition, the location of the air outlet 22 at the side successfully avoids the problem of malfunction due to accumulation of liquids, such as condensation, saliva or perspiration, which has been found to occur when the outlet is positioned in the center bottom portion of the mask.

The mask 12 of the present invention is constructed so as to maximize visibility, thus allowing a paint operator, for example, to have a similar field of vision as he would if he were not wearing the mask. The mask is so constructed as to allow a field of vision through the lens of at least 180 degrees in a horizontal direction from side to side. The field of vision in the upward direction is at least 50 degrees above horizontal while the field of vision in the downward direction is at least 65 degrees below horizontal. It is understood that such a field of vision corresponds to that of typical perfect eye.

The air inlet 20 and outlet 22 connections include a flapper or one-way valve of conventional construction for maintaining airtight operation in allowing air to enter the breathing space within the mask upon demand as the operator inhales and with the outlet allowing air to be exhausted to the immediate surrounding atmosphere upon exhalation.

In a preferred embodiment the facepiece 14 is constructed of translucent material such as clear silicone rubber which is not irritating to the skin. The seal between the facepiece 14 and the head of the operator may be provided by a double feather edge seal 24 which is of known construction. This seal 24 is shown in detail in FIG. 3.

The hose system for providing air to the operator may, for example, be in the form of a length of PVC pipe 26 of 2 inch diameter passing from the roof or the upper portion of a wall of the building or other enclosure and extending downwardly to a position adjacent the floor where, by suitable connector 28, the PVC pipe 26 is connected to a length of heavy hydraulic type hose 30 of about 1½ to 2 inches in diameter which is connected at the waist level of the user by suitable conventional connector 32 of the quick release type to the inlet connector hose 18 of the hose mask 12. The lower end of the connector hose 18 may be secured at the side of the operator to a belt 34 worn around the waist of the operator to assist in providing a secure point of attachment of the hose 30 to inlet connector hose 18. From the waist level, hose 18 extends up over the back of the operator and connects to air inlet connector 20 which is constructed so as to extend rearwardly. In this manner, the hose 18 and connector 20 provide the least disturbance to the operator while work is being performed. The hydraulic type hose 30 should be of sufficient length to allow the operator to move freely within the enclosure while painting or carrying out other functions.

The end of the hose 30 should be provided with a closure cap 40 on a chain 42 or an automatic closing device or other conventional mechanism to allow hose 30 to be closed off upon removal from hose 18 so as to prevent the entry of contaminating liquids or contaminated atmosphere and the like into the interior of the hose 30.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A respirator system to provide air to an operator in an enclosed work environment such as an automobile body shop having side walls bounded at the upper and lower end portions by a ceiling and a floor respectively, wherein the operator is able to move freely within said enclosed environment and to carry out normal operations in a toxic or contaminated environment, and with the system operating such that the air moves to the user by means of the bodily breathing function of the user alone, without an air compressor or a supply of compressed air, comprising:

a hose mask with a gas tight enclosure capable of substantially enclosing the face of the user between forehead and chin and having a facepice with lens mounted therein, said lens being of sufficient size to allow a field of vision of at least 180 degrees in a horizontal direction from side to side, and a field of vision of at least 50 degrees above horizontal and at least 65 degrees below horizontal;

said hose mask being free of structural components between the lens of the facepiece and an inner position corresponding to the location of the face of the user, and extending from the forehead to the chin of said user;

an air inlet positioned at approximately the level of the chin on one side of said hose mask and extending rearwardly from said hose mask;

an air outlet positioned at approximately the level of the chin on the opposite side of said hose mask from said air inlet, each of said air inlet and air outlet having a flapper valve which allows air to flow in one direction only; and hose means for connecting the air inlet of said hose mask in fluid communication with a source of air at atmospheric pressure exterior to said enclosed environment, said hose means including a length of pipe of a rigid material extending from said exterior source of air to a position adjacent the floor, at which position said pipe is connected to a length of heavy hydraulic type hose, said hose means further including an inlet connector hose having one end attached to said air inlet so as to extend rearwardly across the back of the operator, and the other end of said inlet connector hose being secured to a belt to be worn at waist level at a position corresponding to the side of the user, so that said connector hose does not interfere with the performance of tasks in front of the operator, said other end of the inlet connector hose having a quick-release type connector secured thereto for quick-release attachment to said length of hydraulic type hose;

said system thus being fully integrated into the work environment to allow the operator to have improved visibility and to breathe freely in a toxic or contaminated atmosphere while carrying out normal tasks in a routine manner.

2. The respirator system of claim 1 wherein said facepiece is constructed of translucent material.

* * * * *